United States Patent [19]

Cooper et al.

[11] Patent Number: 4,682,627

[45] Date of Patent: Jul. 28, 1987

[54] MANIFOLDING SYSTEMS FOR GAS CONTAINERS

[75] Inventors: Graham H. B. Cooper, Halley, Near Witney; John A. Williams, Brize Norton, both of England

[73] Assignee: Supergas Ltd, United Kingdom

[21] Appl. No.: 731,647

[22] Filed: May 7, 1985

[30] Foreign Application Priority Data

May 23, 1984 [GB] United Kingdom ..... 8413203

[51] Int. Cl.[4] ..... F17C 1/00

[52] U.S. Cl. ..... 137/572; 222/3

[58] Field of Search ..... 137/255, 263, 266, 267, 137/376, 460, 517, 571, 572, 259, 265; 251/144; 222/3, 6

[56] References Cited

U.S. PATENT DOCUMENTS

| | | | |
|---|---|---|---|
| 494,061 | 3/1893 | Day | 137/266 |
| 2,178,564 | 11/1939 | Crocker | 137/266 |
| 2,547,823 | 4/1951 | Josephian | 137/266 |
| 3,054,529 | 9/1962 | Billington | 222/6 |
| 3,120,326 | 2/1964 | Hedeman | 137/266 |
| 3,709,255 | 1/1973 | Ciotti | 137/460 |
| 3,845,787 | 11/1974 | Slagle | 137/571 |
| 3,863,664 | 2/1975 | Holbrook et al. | 137/571 |
| 3,930,598 | 1/1976 | Slagle | 137/266 |
| 3,999,570 | 12/1976 | Clements | 137/517 |
| 4,460,010 | 7/1984 | Paravigna et al. | 137/266 |

*Primary Examiner*—Alan Cohan

*Attorney, Agent, or Firm*—Martin Lukacher

[57] ABSTRACT

A manifolding system for gas containers, such as propane gas cylinders, comprising interconnecting hoses between the containers for permitting gas flow from the containers to an outlet. Each hose has a non-return valve at its end nearer the outlet and an excess-flow valve at its other end, as safety means, in the event of a ruptured hose for example.

9 Claims, 5 Drawing Figures

MANIFOLDING SYSTEMS FOR GAS CONTAINERS

DESCRIPTION OF THE INVENTION

This invention relates to manifolding systems for a plurality of gas containers, such as gas cylinders containing gas under pressure or liquified gas, for example, propane gas cylinders.

The object of the invention is to provide a manifolding system of interconnecting hoses enabling a gas supply to be taken from any or all of the plurality of gas cylinders and to provide safety means preventing an excess forward flow or a reverse flow of gas in the event, for example, of a ruptured hose.

Accordingly, the invention provides a manifolding system for a plurality of gas containers, enabling gas to be supplied to an outlet, comprising a plurality of hoses for connecting said outlet with each of said gas containers, serially, each hose including a non-return valve at its end nearer to said gas outlet and including an excess-flow actuated shut-down valve at its other end.

SHORT DESCRIPTION OF THE DRAWINGS

In order that the invention may be carried into practice, one embodiment will now be described, by way of example, with reference to the accompanying drawings, in which.

DESCRIPTION OF THE EMBODIMENT

Figure 1:
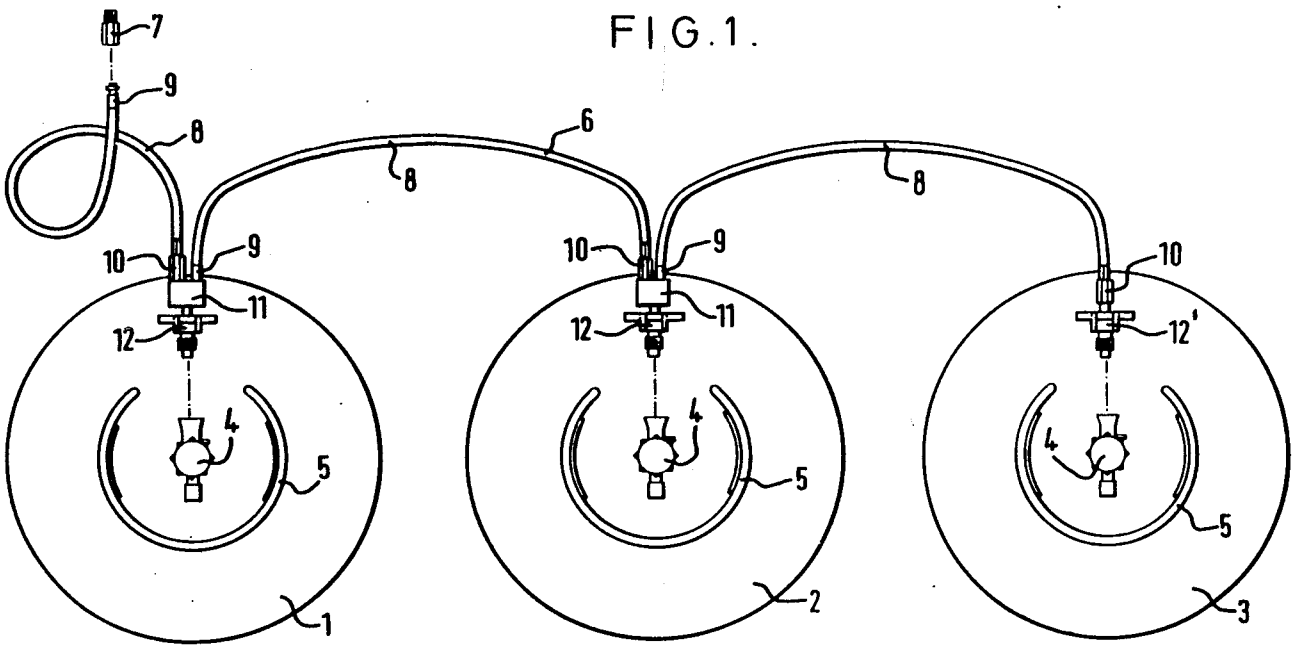
FIG. 1 shows a manifolding system, according to the invention, for connecting three gas containers to a single gas outlet.

Referring first to FIG. 1, there are shown three gas containers 1, 2 and 3, in this example standard propane gas cylinders holding liquified propane gas. The containers 1, 2 and 3 are each similarly provided with a standard controllable gas-flow valve 4 and a valve guard 5.

The manifolding system of the invention, shown generally at 6, serves to connect the three gas containers 1, 2 and 3 serially with a gas outlet adapter 7. The purpose of the adapter 7 is merely to adapt the thread of a non-return valve 9, described in detail with reference to FIG. 3, to that of a pipeline or an appliance to be supplied with gas, and this element need not be further described herein.

As shown in FIG. 1, the manifolding system 6 comprises three hoses 8 each having a non-return valve 9 at its gas-output end and an excess-flow valve 10 at its gas-input end. In the cases of gas-containers 1 and 2, the manifolding system 6 further includes the combination of a double adapter block 11 and a gas-container valve adapter 12. This combination 11, 12 is described in detail with reference to FIG. 2. In the case of the gas-container 3, a modified valve adapter 12' is used.

Figure 2:
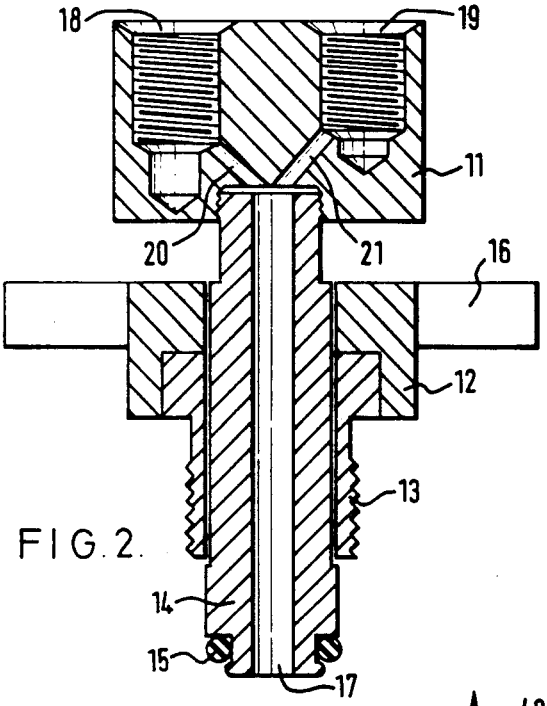
FIG. 2 is an axial sectional view of a double adapter block, required for connecting the manifolding system to all but the last one of the gas containers.

As shown in FIG. 2, the combination comprises the gas-container valve adapter 12 having a male-threaded body 13 with a connecting tube 14 carrying a resilient annular seal 15. This adapter fits the standard gas-release valve 4 fitted to the gas-container and is screwed into attachment with the valve 4 by a three-wing finger nut 16. The adapter end remote from the seal 15 carries a male thread which receives the adapter block 11 and an axial bore 17 extends through the adapter to this threaded end.

The adapter block provides two female-threaded sockets 18 and 19 to receive one an excess-flow valve 10 and the other a non-return valve 9. The two sockets are not interchangeable between the two valve types by reason of different pitch or different diameter threads, or any similar expedient. The threaded ends of the non-return and excess-flow valves are correspondingly distinguished.

The inner ends of the sockets 18 and 19 are respectively provided with oblique bores 20 and 21 which meet on the axis of the bore 17 and provide continuous channels therewith.

Figure 3:
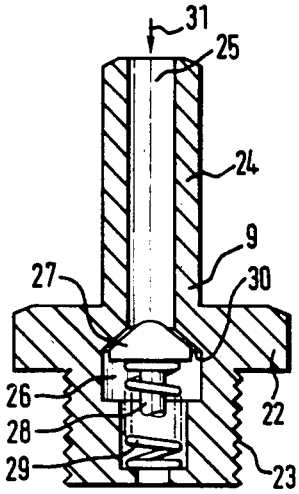
FIG. 3 is an axial sectional view of a non-return valve.

FIG. 3 shows the non-return valve 9 having a hexagonal nut body 22, a male-threaded portion 23 at one end and a cylindrical end 24 at the other to receive a hose 8. An internal bore 25 extends from end to end and is enlarged centrally to form an internal chamber 26. This chamber holds a valve member 28 and bias spring 29. The valve member 28 has a head 27 and seating member 30. As will be evident, flow of gas is possible only in the direction from the end 24 to the end 23, that is in the direction of the arrow 31.

Figure 4:
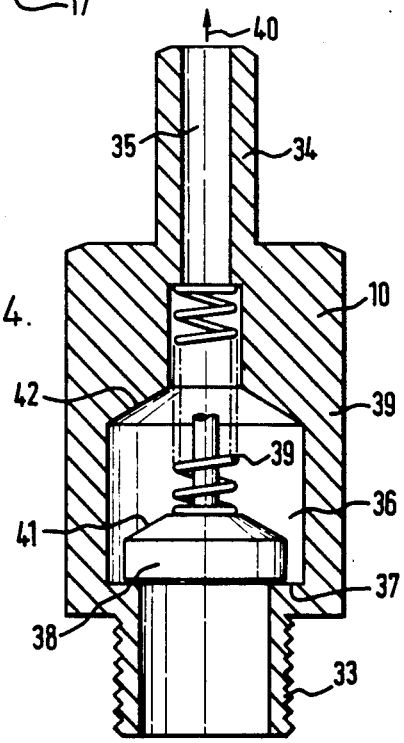
FIG. 4 is an axial sectional view of an excess-flow valve.

FIG. 4 shows the excess-flow valve 10 having a hexagonal nut body 32, a male threaded portion 33 at one end a cylindrical end 34 at the other to receive a hose 8. An internal bore 35 extends from end to end and is enlarged centrally to form an internal chamber 36. This chamber holds a valve member 38 and a bias spring 39. As shown in the drawing, and as aided by the spring 39, the head of the valve member 38 seats against a shoulder 37 of the chamber 36 and is lifted therefrom by gas flow in the direction from end 33 to end 34, that is in the direction of the arrow 40. In the event of excess gas flow in the direction of arrow 40, the valve member is moved sufficiently against the spring 39 that a tapered face 41 of the valve head seats against a tapered face 42 of the chamber 36. The valve 38 is held in this position by the excess gas pressure acting against the spring 39 and the gas supply along bore 35 is stopped.

A by-pass bleed channel, not shown, can be provided to permit a restricted gas flow, if such is required.

Referring again to FIG. 1, each hose 8 has an excess-flow valve 10 at its supplied end and a non-return valve 9 at its gas-supplying end. As stated earlier, the threaded valve ends 23 and 33 are not interchangeable. As the outlet adapter 7 receives only a non-return valve 9, the hoses can be connected only in the sequence and in the flow-sense shown in FIG. 1.

Figure 5:
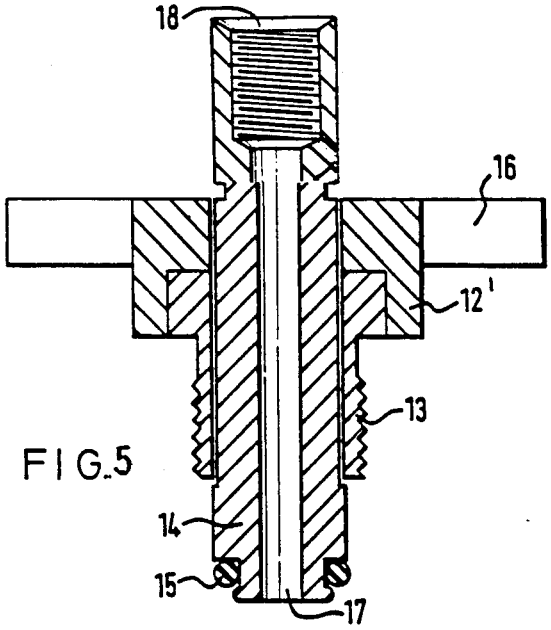
FIG. 5 is an axial sectional view of a single adapter block used in the last one of the gas containers.

The gas-container valve adapter 12' shown in FIG. 1 and FIG. 5 differs from the adapter 12 solely in having a female-threaded socket to receive the male-threaded end 33 of an excess-flow valve 10, in place of the male end shown in FIG. 2.

In an alternative construction, not shown in the drawings, which permits of the use of a uniform adapter 12 construction for all the gas-containers, the final adapter 12' is provided with a single adapter block having two female-threaded sockets, one for the male-threaded end of the adapter 12 and the other for the male-threaded end 33 of the valve 10.

In use, the manifolding system can be used for any plural number of gas-containers, any or all of which can be set to supply gas to the manifold by setting the individual valves 4. Each hose 8 used is identical and can be fitted, in the correct flow sense, by unskilled labour. When a hose becomes worn or defective, it can be replaced together with its end valves.

In the event of rupture of any hose 8, gas supply will continue from the down-stream side of the rupture and the excess-flow cut-off valves will operate to isolate all gas-containers on the up-stream side of the ruptured hose.

In the event of a pipe fracture or other serious leak beyond the outlet adapter 7, the excess-flow valves 10 will operate to protect the entire manifolded gas-supply system.

I claim:

1. A manifolding system for plurality of gas containers, containing gas under pressure or liquefied gas similarly under pressure, enabling gas to be supplied to an outlet, comprising a plurality of hoses for connecting said outlet with said gas containers serially, each hose including a pressurized gas flow, non-return valve at its end nearer to said gas outlet and including a pressurized gas excess-flow actuated shutdown valve at its other end.

2. A manifolding system as claimed in claim 1, including a gas-container valve adapter for each said gas container providing for gas-flow therefrom.

3. A manifolding system as claimed in claim 2, in which each said gas container, except that gas container most remote from said outlet in said serially-connected plurality, includes a double adapter block for connection thereto of incoming and outgoing gas-flow hoses.

4. A manifolding system as claimed in claim 3, in which each said double adapter block provides a direct gas-flow connection between said incoming and outgoing gas-flow hoses.

5. A manifolding system as claimed in claim 4, in which the said gas-container valve adapter for said gas container most remote from said outlet in said serially-connected plurality has a gas-container valve adapter and adapter block providing connection solely for an outgoing gas-flow hose.

6. A manifolding system as claimed in claim 5, in which each gas-container valve adapter includes a wing-nut rotatable screw connector to the respective gas container.

7. A manifolding system as claimed in claim 3, in which each gas-container valve adapter and includes an O-ring gas seal.

8. A manifolding system for a plurality of gas containers containing gas, which may be liquified gas, under pressure and for supplying said gas to an outlet, comprising a first hose element for connecting the first of said plurality of gas containers to said outlet having a pressurized gas excess-flow actuated shut-down valve for its end remote from said outlet, at least one second hose element for serially connecting at least one other gas container of said plurality to said outlet, each said second hose element comprising a hose portion with a pressurized gas flow non-return valve for its end nearer said outlet and a pressurized gas excess-flow actuated shut-down valve for its end remote from said outlet, said non-return and said excess-flow valves having dissimilar hose element end connections, a double adapter block for connection to each one of said plurality of gas containers except the last thereof in said series, and each adapter block providing connection for a non-return valve of an incoming flow hose element and also providing connection for an excess-flow valve of an outgoing flow hose element.

9. A manifolding system as claimed in claim 8, in which each said hose element is separately attachable to and detachable from the respective said gas containers.

* * * * *